United States Patent [19]

Wrossok

[11] Patent Number: 4,476,914

[45] Date of Patent: Oct. 16, 1984

[54] METHOD AND APPARATUS FOR COOLING METAL STRANDS, MORE PARTICULARLY SLAB AND BILLET STRANDS

[75] Inventor: Willi Wrossok, Düsseldorf, Fed. Rep. of Germany

[73] Assignee: SACK GmbH, Düsseldorf, Fed. Rep. of Germany

[21] Appl. No.: 346,142

[22] Filed: Feb. 5, 1982

Related U.S. Application Data

[63] Continuation of Ser. No. 187,363, Sep. 15, 1980, abandoned.

[30] Foreign Application Priority Data

Sep. 28, 1979 [DE] Fed. Rep. of Germany ..... 2939322

[51] Int. Cl.[3] ..... B22D 11/124

[52] U.S. Cl. ..... 164/444; 164/486

[58] Field of Search ..... 164/444, 486

[56] References Cited

U.S. PATENT DOCUMENTS 2,726,430 12/1955 Rossi et al. ..... 164/455

4,031,946 6/1977 Marti et al. ..... 164/444 X 4,256,168 3/1981 Hein et al. ..... 164/444

*Primary Examiner*—Kuang Y. Lin

*Attorney, Agent, or Firm*—Schwartz, Jeffery, Schwaab, Mack, Blumenthal & Koch

[57] ABSTRACT

So-called spraying beams, being supports for spraying tubes or nozzles, are arranged in a continuous casting plant for cooling the strand along the surface thereof relative to the strand surface so that the width of the fan-shaped cooling water jets can be adapted to changing strand widths and thicknesses. The adjusting device for the spraying beams comprises two or more pivotable radius levers to which the spraying beams are connected, at least in zones, and which said levers can be locked in different pivoting positions so that the spraying beams or zones of spraying beams can be adjusted parallel with themselves and can be locked at different distances. The radius levers can also be pivotable along inclined planes so that the change of distance of the spraying beam is accompanied by a transverse displacement relative to the longitudinal axis of the strand.

3 Claims, 2 Drawing Figures

Figure 1:
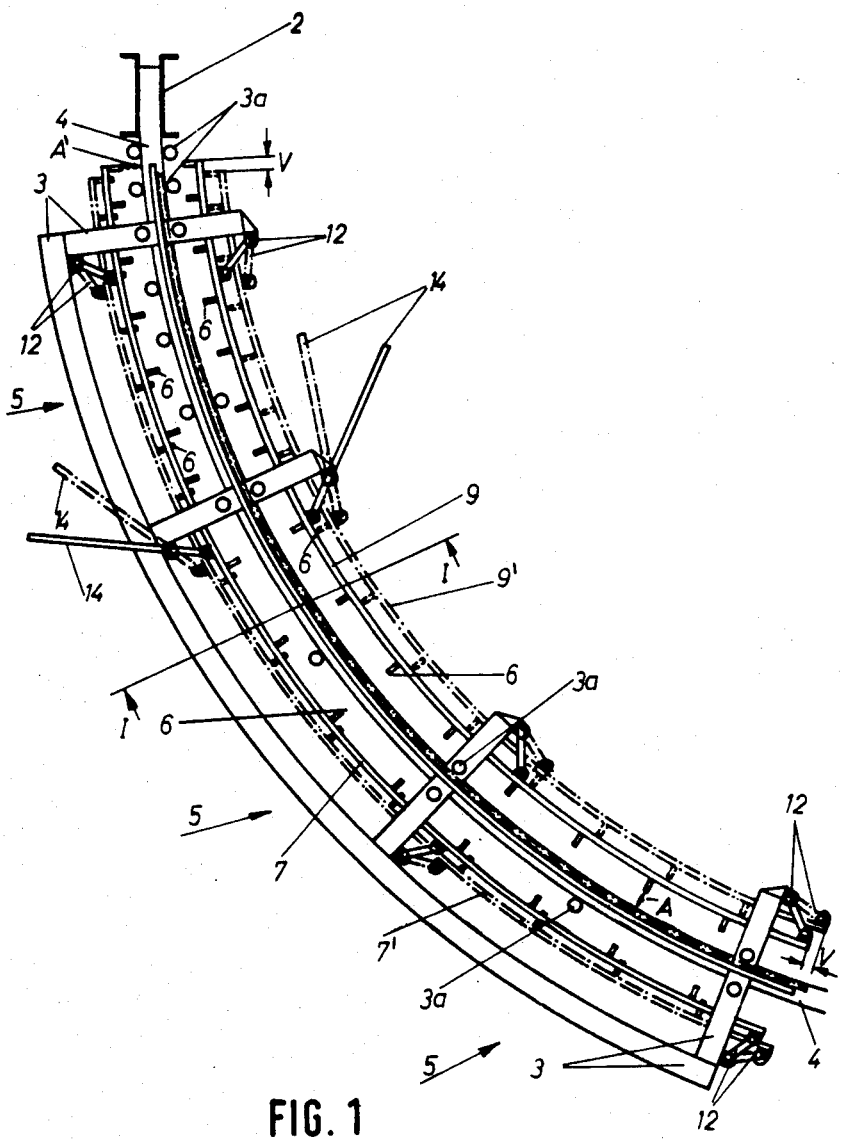

METHOD AND APPARATUS FOR COOLING METAL STRANDS, MORE PARTICULARLY SLAB AND BILLET STRANDS

This is a continuation, of application Ser. No. 187,363, filed Sept. 15, 1980 abandoned.

This invention relates to an adjusting device for so-called spraying beams which extend along the surface of a strand associated with a continuous casting plant and function as supports for spraying tubes or nozzles, which are oriented on to the surfaces to treat the same with a cooling medium, for example water, and said adjusting device is provided to alter the distance between the spraying beams and the strand in adaptation to changing strand widths and/or strand thicknesses.

It is known that primary solidification of the strand in a continuous casting plant takes place in the mould and is followed by secondary cooling and by a residual cooling section. The first crystals to solidify in the mould form a thin strand skin which develops further in the course of secondary cooling, resulting from the application of a cooling medium such as water, vapour, water-air mixture, air and the associated removal of heat until complete solidification is achieved. The most conventional coolant, namely water, is sprayed by means of spraying nozzles on to the free surfaces of the strand between the support elements of the strand guide.

To cool broad slab strands it is known from the German Offenlegungsschrift No. 1 936 306 to subdivide the strand guide adjoining the mould into a desired number of cooling zones and to provide such zone with supply ducts which are disposed centrally with respect to the top and bottom of the strand.

The supply ducts have a large number of spraying nozzles and, to obtain adaptation to different strand widths, they are constructed so that they can be raised and lowered by means of a motor and a spindle and spindle nut, so that the distance beween the strand surface and the spraying nozzles, which are supported by a supply duct, can be jointly adjusted.

The known adjusting device is however unsuitable to ensure necessary and operationally reliable functioning. It must be remembered that the curved portion of the strand guide in continuous casting plants is provided with a closed cooling chamber which comprises the entire region of spray cooling. During casting operation, conditions in the cooling chamber are defined by the cooling water which is sprayed on to the hot strand. This results in a saturated steam mixture having a temperature of approximately 80° to 100° C. in the region of the roller guide. Unevaporated cooling water, which is heated by the hot strand, flows over all the structural components and because of the entrained casting flux and scale which is flushed off, leads to deposits on the surfaces of the structural components. These conditions lead to substantial damage and impair the spindle adjusting device and within a very short time cause failure of the spindle adjusting mechanism.

It is therefore the object of the invention to improve the operational reliability of the continuous casting plant and to provide for the spraying beams of a continuous casting plant an adjusting device which is trouble-free and can be simply and rapidly manipulated.

To solve this problem, the invention proposes that the spraying beams are adjustable parallel with themselves via two or more radius levers, at least in zones, and are lockable at different distances from the strand surface. Because of its simplicity and ruggedness, the radius lever guide between the strand guide scaffolding and the spraying beam is able to withstand the above-described adverse conditions and to ensure adjustment of the spraying beams. Setting the distance from the strand is obtained by adjusting the levers along the line of the longitudinal strand axis. To this end, pivotable adjusting levers are associated with the spraying beams, which advantageously do not comprise a plurality of individual spraying beams on each intended cooling side of the strand but are formed by spraying beams which extend continuously over the entire region of secondary cooling. The pivotable adjusting levers which act either on a radius lever or on the spraying beam itself, can be fixed in specific pivoting positions over their adjusting range. The adjusting lever is pivoted by an operator or by mechanical actuation in the simplest possible manner until a lever bore is situated opposite a corresponding bore in the strand guide frame, and the adjusting lever is provided with a plurality of bores which correspond with the section sizes to be cast and define the distance of the spraying beam for each individual strand size. By engaging a bolt in the bores the previously selected distance of the spraying beam with the spraying nozzles from the strand surface is therefore obtained in the shortest possible time without any further adjusting manipulation.

Approximately identical cross-sectional conditions occur uniformly during solidification when billets and slabs with identical edge lengths are continuously cast and such sizes are advantageously cooled on the top and bottom of the strand as well as on the two other sides and to this end supply lines or spraying beams which are provided with spraying tubes or spraying nozzles are arranged on all four sides parallel with the strand. Special conditions apply to the resetting for different strand dimensions because in addition to the rise and fall motion of the spraying beams on the top and bottom of the strand and additionally to the advance motion of the lateral spraying beams the latter must also be set to the centre of the new size relative to the side surfaces of the strand. This is because in continuous casting the spraying tubes should be oriented towards the centre of the strand perpendicularly thereto, so that owing to the danger of cracks at the edges, the types of steel, which are usually very sensitive, are allowed to come into contact with the spraying cone only in the middle region of the strand without however having a resort to expensive control means on the nozzle diaphragms themselves.

The spindle adjusting means of the spraying beams usually used for slab strands, are unsuitable because they are trouble-prone, and, as already mentioned, this is exacerbated by the difficult conditions in the cooling chamber of a continuous casting plant and because such means cannot perform any adjustment which, in addition to the motion towards the strand or away therefrom, permit a further different adjusting motion, in the particular case to obtain adaptation to different strand centres. Hitherto, adjustment of the spraying beams made it necessary for such spraying beams, secured by means of bolts or screwfasteners to the scaffolding structure, to be manually set to the appropriate distance from the strand surface and to the new strand centre by means of shims and additional spacers on both sides. Such a resetting operation is possible only with a substantial expenditure of time, even when several operators are employed to this end.

It is therefore also the object of the invention to avoid the above-mentioned disadvantages and to provide a rapid and simple centre-oriented adaptation of spraying beams which are associated with a strand surface whose centre is displaced with a varying strand width and/or thickness, more particularly in continuous casting plants for slabs and billets.

To solve this problem, the invention provides that the radius levers are pivotable along inclined planes which form an acute angle with the respective spraying plane extending perpendicularly to the associated strand surface through spraying tubes or nozzles, so that a change of distance of the spraying beams is accompanied by a transverse displacement of the spraying beams together with the spraying tubes or nozzles relative to the longitudinal axis of the strand. Owing to the inclined arrangement of the radius levers at a specific angle to the strand, those spraying beams which must be newly adjusted to the centre of the strand format when the format is changed, perform a motion transversely to the longitudinal axis of the strand together with the motion along the longitudinal axis of the strand, so that the edge regions of the strand remain unbiased by the water in the desired manner and the spraying tubes are pointed towards the middle of the strand.

In a continuous casting plant with spraying beams extending over the entire length of the secondary cooling section, the invention further provides that the spraying tubes or spraying nozzles are constructed with different lengths and are brought progressively closer to the strand surface in the regions which are at the bottom as seen from the mould. It is known that the secondary cooling section of a continuous casting plant can be subdivided into cooling zones which are controlled independently of each other, taking into account the steel grade which is to be cast, and it is perfectly feasible for spray cooling to be no longer necessary in the lowest cooling zone or zones and the affected zone can therefore be switched off. It is certainly no longer necessary and in some cases even detrimental to apply cooling water over the entire width of the bottom cooling zones of the strand where the said strand is progressively completely solidified. Spraying tubes of different length account for this effect. On the assumption that a uniform, continuous spraying beam is adjusted once over the entire length of the strand guide and is set at the desired distance from the strand, the shorter spraying tubes at the beginning of the cooling section where the strand core is still predominantly liquid, the strand surface can be biased at the rate of, for example, 80%, while in the lower cooling region the spraying angle is substantially narrowed by the longer spraying tubes which are set at a shorter distance from the strand surface so that in this case the strand surface is biased only to the extent of, for example 40%.

Figure 2:
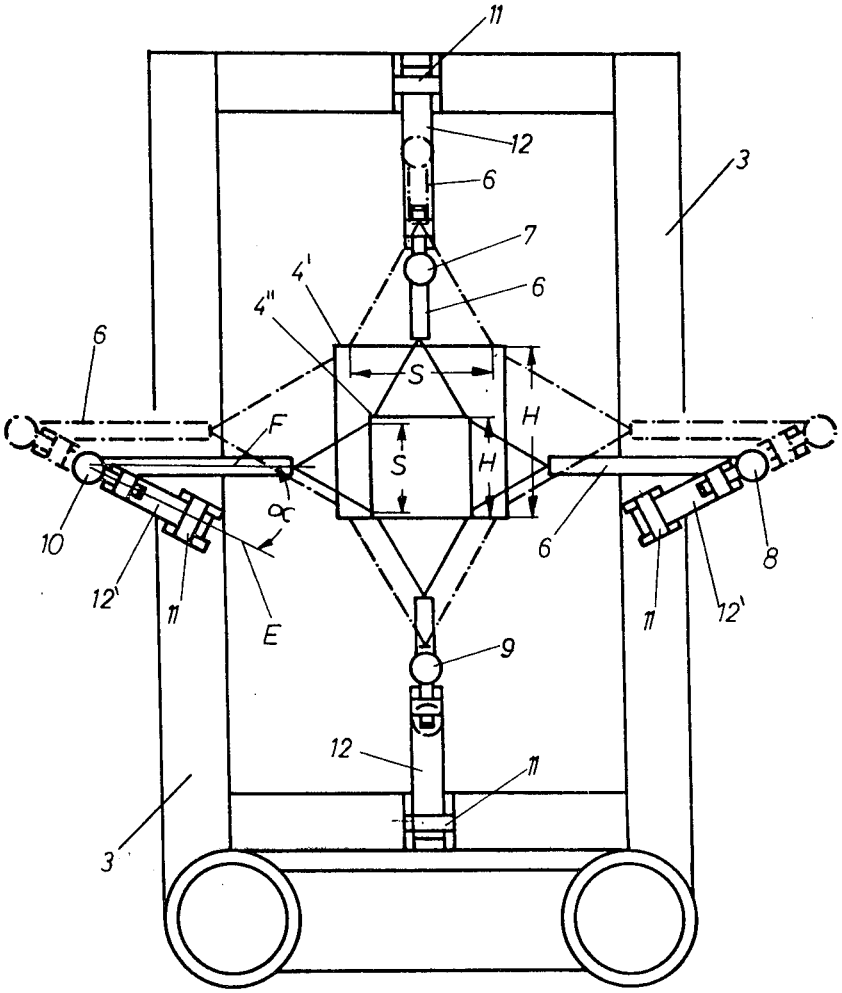

One exemplified embodiment of the subject of the invention is explained by reference to the accompanying drawing in which:

FIG. 1 is a diagrammatic side view of a continuous casting plant with a curved run-out for square billets and FIG. 2 is a section along the line I—I according to FIG. 1.

In the embodiment according to FIG. 1 steel flows from an intermediate vessel, not shown, into a continuous casting mould 2. The strand guide scaffolding 3 is disposed to adjoin the mould 2 and guides the strand 4, whose surface zones are already solidified below the mould, by means of the support rollers 3*a*, situated in the strand guide scaffolding, to transfer said strand into the circular arc of the continuous casting plant. On exiting from the mould 2, where the strand 4 experiences primary cooling, the strand passes into the part of the continuous casting plant referred to as secondary cooling section. While passing through the support rollers 3*a* of the cooling section, heat is abstracted from the strand 4 by means of water sprayed on said strand through spraying tubes or nozzles 6. To this end, spraying beams 7, 8, 9, 10 which extend over the top and bottom side of the strand as well as over the two other strand sides, are provided over the entire length of the secondary cooling section. The secondary cooling section can also be subdivided into cooling zones 5. The spraying beams support a plurality of spraying tubes 6 which must always be oriented centrally with respect to the strand 4.

The spraying beams 7, 8, 9, 10, which are connected to a water supply through pipelines not shown, are connected to the strand guide or support roller frame 3 by means of a plurality of radius levers 12, 12′ which are pivotably supported by a plurality of bolts 11 in the manner of a parallelogramatic radius link system. To permit adpation to different strand sizes, the distance of each spraying beam from the strand surface can be varied by means of a pivotable adjusting lever 14 as illustrated in FIG. 1 for the spraying beam 7 on the underside of the strand and for the spraying beam 9 on the top of the strand in relation to the spraying beam positions 7′, 9′ which are situated at a distance from the strand 4. As solidification of the strand 4 progresses, the spraying tubes 6 have a longer length so that the distance A between the spraying tubes and the strand surface in the bottom region of the strand guide is less than the distance A′ in the top part of the strand guide. This step makes it possible for the spraying angle and therefore for the biased cooling surface area S on the top of the strand to be reduced as solidification of the strand progresses.

As can readily be seen by reference to the simplified sectional view of FIG. 2, special problems arise if different sizes, for example 4′ and 4″, are to be produced by the continuous casting plant, because it is essential for cooling that the spraying tubes 6 must be positioned centrally with respect to the strand and the edge regions thereof must not be biased by cooling water, irrespective of the strand cross-section. To satisfy these requirements the spraying beam 4 on the underside or fixed side of the strand must have a setting which is different from that of the spraying beam 9 on the top side or loose side of the strand. Different conditions again apply to the lateral spraying beams 8 and 10. The underside or fixed side of the strand is merely subject to a change of strand width accompanying a change of strand cross-section; the central position of the spraying tubes 6, set centrally with respect to the strand, is necessarily ensured with a change of distance when the mould is changed. This also applies to the top side or loose side of the strand but a change of dimension of the height of the strand or thickness H must be added so that the adjusting distance on the loose side must always be greater than on the fixed side. This adjustment itself is obtained by pivoting of the adjusting levers 14 which adjust the pivotably supported radius levers 12 in the direction towards the longitudinal axis of the strand so that a spraying beam 7, 9 approaches to or recedes from the top surface of the strand and in addition performs a parallel displacement either towards the mould or towards the driving unit, as can be seen by reference to FIG. 1 where the spraying beam 9 is set further in the direction towards the mould 2 than the receding spraying beam 9'. Such offset V is within the range of distance of two adjacent support rollers 3*a* which are in any case arranged adjacently at a substantial distance from each other in billet and slab casting plants.

Apart from the adjustment towards the strand or away therefrom it is essential that the lateral spraying beams 8, 10 are also readjusted to the strand centre. To enable such setting to be obtained without additional manipulations, the lateral radius levers 12' are pivotably arranged along an inclined plane E which extends at a specific angle $\alpha$ to the spraying tube plane F which extends perpendicularly to the associated strand surface. When the smallest sizes are cast, the lateral spraying beams 8, 10 are set closely together, as illustrated in FIG. 2 in solid lines, and the distance between the spraying tubes 6 and the strand surface is only small and so arranged that the spraying cone of base area S does not cover the edge regions of the strand. For increasing strand dimensions and as shown for the largest size 4', the spraying beams 8, 10 in dash dot lines together with the spraying tubes 6 are set at a long distance from the strand surface with the condition that the enlarged strand surface area is adequately biased with water but the edge regions of the strand are again not biased by water. To this end however it is necessary that the spraying beams 8, 10 perform a motion transversely to the longitudinal axis of the strand in addition to the advance motion, i.e. in the direction of thickness change, so as to be readjusted to the centre of the second strand format, a function which is achieved by the inclined plane E through which the radius levers 12' pivot, together with a change of distance.

As a result, it is possible with the device according to the invention to perform time-saving adjustment of all spraying tubes solely by virtue of the fact that the adjusting lever 14 associated with each spraying beam and therefore all radius levers 12, 12' are moved into a premarked pivoting position corresponding to the appropriate strand format and are fixed in such position.

What is claimed is:

1. A device for adjusting the secondary cooling of a continuous cast strand emerging in a longitudinal path from a continuous casting mold, to compensate for variations in the width of the strand surfaces comprising:

(a) a strand guide support adjacent to and substantially surrounding said path;

(b) a plurality of coolant spray nozzles positioned to define spray planes crossing said path;

(c) elongated spray beams extending substantially parallel to said longitudinal path and adjacent thereto, said spray beams including at least one lateral spray beam positioned at a side of said path and upper and lower spray beams positioned above and below said path, respectively, and each of said spray beams forming a common support for a plurality of said spray nozzles;

(d) pivot bolts on said strand guide support;

(e) a plurality of guide levers, each of said guide levers pivotally attached to one of said pivot bolts on said strand guide support and to one of said spray beams, said pivot bolts having longitudinal axes being substantially transverse to the longitudinal axis of said path;

(f) means associated with said strand guide support and said lateral spray beam for selectively adjusting and fixing the pivotal position of said guide lever attached to said lateral spray beam, whereby the pivotal position determines the distance of said spray nozzles supported on said lateral spray beam from said path, wherein said pivot bolts attached to said guide levers attached to said lateral spray beam are positioned on said strand guide support at an angle relative to the strand surface whereby said guide levers of said at least one lateral spray beam pivot around said pivot bolts in a plane forming an acute angle with the plane defined by the nozzles supported by said lateral spray beam, and said adjusting means displaces said at least one lateral spray beam transversely to and longitudinally along said path.

2. The device recited in claim 1 wherein said spray nozzles are spaced at progressively shorter distances from said path in the direction of the forward motion of the strand.

3. The device recited in claim 1 wherein said spray beams are subdivided into zones in the longitudinal direction of said path and at least two of said guide levers are provided for each of said spray beams of each of said zones.

* * * * *